US007789669B1

(12) United States Patent
Duesterhoeft et al.

(10) Patent No.: US 7,789,669 B1
(45) Date of Patent: Sep. 7, 2010

(54) REMOVABLE CARD CONNECTOR ASSEMBLIES HAVING FLEXIBLE CIRCUITS

(75) Inventors: Scott Stephen Duesterhoeft, Etters, PA (US); Jason M'Cheyne Reisinger, Carlisle, PA (US); Robert Neil Mulfinger, York Haven, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/428,851

(22) Filed: Apr. 23, 2009

(51) Int. Cl.
*H01R 9/09* (2006.01)

(52) U.S. Cl. ..... 439/65; 439/260; 439/67

(58) Field of Classification Search ..... 439/65, 439/260, 67, 62, 77, 493
See application file for complete search history.

(56) References Cited

U.S. PATENT DOCUMENTS

| | | | | |
|---|---|---|---|---|
| 4,085,990 | A | 4/1978 | Jayne | |
| 4,518,210 | A | 5/1985 | Morrison | |
| 4,603,928 | A | 8/1986 | Evans | |
| 4,626,056 | A | 12/1986 | Andrews, Jr. et al. | |
| 4,629,270 | A | 12/1986 | Andrews, Jr. et al. | |
| 4,693,529 | A * | 9/1987 | Stillie | 439/67 |
| 4,731,698 | A | 3/1988 | Millot et al. | |
| 4,840,569 | A | 6/1989 | Cabourne | |
| 4,881,901 | A * | 11/1989 | Mendenhall et al. | 439/65 |
| 5,092,781 | A | 3/1992 | Casciotti et al. | |
| 5,102,342 | A | 4/1992 | Marian | |
| 5,171,154 | A | 12/1992 | Casciotti et al. | |
| 5,228,863 | A | 7/1993 | Campbell et al. | |
| 6,062,872 | A | 5/2000 | Strange et al. | |
| 6,077,090 | A | 6/2000 | Campbell et al. | |
| 6,411,517 | B1 | 6/2002 | Babin | |
| 6,672,878 | B2 | 1/2004 | Dean | |
| 7,297,015 | B1 | 11/2007 | Desrosiers et al. | |
| 7,374,441 | B2 | 5/2008 | Rubenstein | |
| 7,419,400 | B1 | 9/2008 | Taylor et al. | |
| 7,425,134 | B1 | 9/2008 | Taylor | |
| 7,438,582 | B2 | 10/2008 | Taylor | |
| 7,632,106 | B2 * | 12/2009 | Nakamura | 439/66 |
| 2007/0097662 | A1 | 5/2007 | Dean | |
| 2008/0227314 | A1 | 9/2008 | Taylor | |

* cited by examiner

*Primary Examiner*—Gary F. Paumen

(57) ABSTRACT

A removable card connector assembly configured to be inserted into and engage an electrical system. The card connector assembly includes a circuit board that has a surface extending along a board plane in a longitudinal direction. The card connector assembly also includes an electrical connector assembly that is coupled to the surface of the circuit board. The electrical connector assembly includes a flexible circuit and a moveable contact array of mating contacts that are coupled to the flexible circuit. The moveable contact array is configured to engage a system contact array of mating contacts in the electrical system. The card connector assembly also includes a coupling mechanism that is configured to move the moveable contact array between retracted and engaged positions. The mating contacts of the moveable contact array are arranged along a contact plane that extends in the longitudinal direction when in the engaged position.

20 Claims, 11 Drawing Sheets

REMOVABLE CARD CONNECTOR ASSEMBLIES HAVING FLEXIBLE CIRCUITS

CROSS-REFERENCES TO RELATED APPLICATIONS

Subject matter described herein is similar to subject matter described in U.S. patent application Ser. No. 12/428,806, filed on Apr. 23, 2009, and entitled "CONNECTOR ASSEMBLIES AND SYSTEMS INCLUDING FLEXIBLE CIRCUITS", which is incorporated by reference in the entirety.

BACKGROUND OF THE INVENTION

The subject matter herein relates generally to interconnecting circuit boards, and more particularly, to electrical connector assemblies that are configured to electrically couple arrays of contacts.

Some electrical systems, such as servers, routers, and data storage systems, utilize connector assemblies for transmitting signals and/or power through the electrical system. Such connector assemblies typically include a backplane or a midplane circuit board, a motherboard, and a plurality of daughter cards. The connector assemblies also include one or more electrical connectors that are attached to the circuit board(s) for interconnecting the daughter cards to the circuit board(s) when the daughter card is inserted into the electrical system. Each daughter card includes a header or receptacle assembly having a mating face that is configured to connect to a mating face of the electrical connector. The header/receptacle assembly is typically positioned on or near a leading edge of the daughter card. Prior to being mated, the mating faces of the header/receptacle assembly and the electrical connector are aligned with each other and face each other along a mating axis. The daughter card is then moved in an insertion direction along the mating axis until the mating faces engage and mate with each other.

The conventional backplane and midplane connector assemblies provide for interconnecting the daughter cards to the backplane or midplane circuit board by moving the daughter card in an insertion direction which is the same as the mating direction. In some cases it may be desirable to mate the daughter card in a mating direction that is perpendicular to the insertion direction. However, when the header/receptacle assembly is on a surface of the daughter card and faces a direction perpendicular to the insertion direction and the electrical connector is on the backplane circuit board and also faces a direction perpendicular to the insertion direction, the daughter card and the backplane circuit board may be misaligned and unable to connect. In addition, connector assemblies that include a backplane or midplane circuit board may affect the electrical system's cooling capabilities by, for example, limiting airflow through the system.

Accordingly, there is a need for an electrical connector assembly that facilitates interconnection of circuit boards that are oriented in an orthogonal relationship. Furthermore, there is also a need for alternative electrical connector assemblies that are capable of connecting daughter cards to a backplane or midplane circuit boards of the subject systems.

BRIEF DESCRIPTION OF THE INVENTION

In one embodiment, a removable card connector assembly configured to be inserted into and engage an electrical system is provided. The card connector assembly includes a circuit board that has a surface extending along a board plane in a longitudinal direction. The card connector assembly also includes an electrical connector assembly that is coupled to the circuit board. The electrical connector assembly includes a flexible circuit and a moveable contact array of mating contacts that are coupled to the flexible circuit. The moveable contact array is configured to engage a system contact array of mating contacts in the electrical system. The card connector assembly also includes a coupling mechanism that is configured to move the moveable contact array between a retracted position, at which the moveable contact array is located remotely from the system contact array, and an engaged position, at which the moveable and system contact arrays are engaged with one another. The mating contacts of the moveable contact array are arranged along a contact plane that extends in the longitudinal direction when in the engaged position.

In another embodiment, an electrical system is provided that includes an electrical component that has a system contact array of mating contacts extending along a surface thereof. The electrical system also includes at least one removable card connector assembly that is configured to be inserted alongside and engage the electrical component. The card connector assembly includes a circuit board that has a surface extending along a board plane in a longitudinal direction and an electrical connector assembly coupled to the circuit board. The electrical connector assembly includes a flexible circuit and a moveable contact array of mating contacts coupled to the flexible circuit. The moveable contact array is configured to engage the system contact array of mating contacts. The card connector assembly also includes a coupling mechanism that is configured to move the moveable contact array between a retracted position, at which the moveable contact array is located remotely from the system contact array, and an engaged position, at which the moveable and system contact arrays are engaged with one another. The mating contacts of the moveable contact array are arranged along a contact plane that extends in the longitudinal direction when in the engaged position.

DETAILED DESCRIPTION OF THE INVENTION

Figure 1:
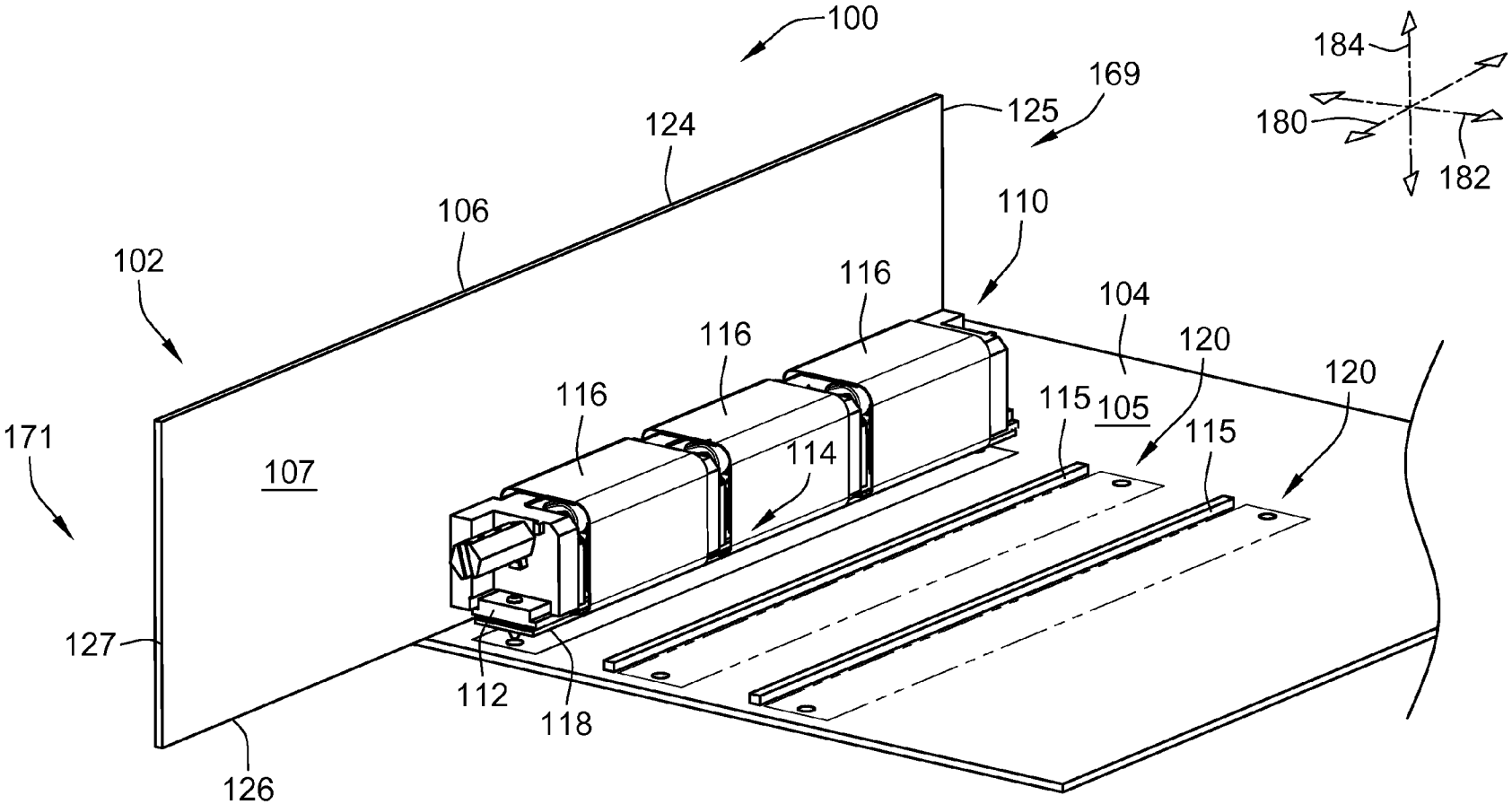
FIG. 1 is a perspective view of an electrical system formed in accordance with one embodiment that includes a removable card connector assembly.

FIG. 1 is a perspective view of an electrical system 100 formed in accordance with one embodiment that includes a removable card connector assembly 102 and a primary circuit board 104. The card connector assembly 102 includes a secondary circuit board 106 having a surface 107 and an electrical connector assembly 110 that is coupled to the surface 107 of the secondary circuit board 106. The card connector assembly 102 has a leading end 169 and a trailing end 171, and the secondary circuit board 106 is defined by side edges 124-127. The electrical connector assembly 110 includes a mating side 112 that is configured to be removably coupled to a system contact array 120 of mating contacts along a surface 105 of the primary circuit board 104. As one example for the electrical system 100, the card connector assembly 102 may be a part of a server blade and the primary circuit board 104 may be a mother board of a server system.

However, the electrical system 100 shown in FIG. 1 may be a variety of other electrical systems, such as a router system or data storage system. Furthermore, although the illustrated embodiment is described with reference to interconnecting the primary and secondary circuit boards 104 and 106, the description herein is not intended to be limited to circuit boards. Embodiments described herein may be used to interconnect other electrical components where one component has an array of mating contacts and the other component has a complementary array of mating contacts 120.

When the card connector assembly 102 and the primary circuit board 104 are to be engaged, the card connector assembly 102 may be advanced along the surface 105 in a longitudinal mating direction (i.e., along a longitudinal axis 180). For example, the card connector assembly 102 may slidably engage guiding features 115, which are illustrated as rails in FIG. 1, and slide to a predetermined position and orientation with respect to the contact array 120. Once the card connector assembly 102 is properly positioned alongside the contact array 120, the mating side 112 may be moved to engage the contact array.

As shown in FIG. 1, the electrical connector assembly 110 includes a circuit assembly 114 having the mating side 112 and one or more flexible circuits 116. The circuit assembly 114 communicatively couples the primary and secondary circuit boards 104 and 106 by providing conductive paths therebetween. The mating side 112 may include one or more moveable contact arrays 118 that are configured to be moved toward and away from the contact array 120 of mating contacts on the primary circuit board 104. As will be discussed in greater detail below, embodiments described herein are configured to move the contact array 118 between a retracted position 190 (shown in FIG. 2A) and an engaged position 192 (shown in FIG. 2A). When in the engaged position 192, electrical connector assembly 110 is electrically coupled to the contact array 120 through the contact array 118. Accordingly, the electrical connector assembly 110 is configured to interconnect the primary and secondary circuit boards 104 and 106.

As used herein, the term "contact array" includes a plurality of mating contacts arranged in a predetermined configuration and held together by a common base material or structure. For example, a contact array may include or be part of a printed circuit or an interposer. A variety of mating contacts may be used in the contact arrays, including contacts that are stamped and formed, etched and formed, solder balls, pads, press-fit contacts, and the like. In some embodiments, the mating contacts form a planar array (i.e., the mating contacts are co-planar with respect to each other), but the mating contacts may form other arrangements in alternative embodiments. For example, the contact array may have multiple sub-arrays of mating contacts where each sub-array extends along a different plane.

As used herein, "removably coupled" means that the two coupled components, such as the mating side 112 and the primary circuit board 104, may be readily separated from and coupled to each other without destroying or damaging either of the components or corresponding mating contacts. As used herein, a "removable card connector assembly" is a card connector assembly that is configured to be positioned within an electrical system in a predetermined orientation and be removably coupled to an electrical component, such as the primary circuit board 104. A removable card connector assembly may be sized and shaped so that the card connector assembly may be carried and inserted/removed by an operator or an automated machine. Furthermore, a removable card connector assembly may have sufficient structure to withstand repeated insertions and removals from a corresponding electrical system without damaging the card connector assembly.

The term "printed circuit," as used herein, includes any electric circuit in which the conducting connections have been printed or otherwise deposited in predetermined patterns on an insulating base. For example, a printed circuit may be a circuit board, an interposer made with printed circuit board material, a flexible circuit, a substrate having one or more layers of flexible circuit therealong, and the like. In the illustrated embodiment, the contact arrays 118 and 120 are part of printed circuits. More specifically, the contact array 118 may be part of an interposer manufactured from PCB and the contact array 120 may be part of the primary circuit board 104. A "flexible circuit" (also called flex circuit), as used herein, includes a printed circuit having an arrangement of conductors embedded within or between flexible insulating material(s). For example, the flexible circuit(s) 116 is configured to convey an electrical current between the primary and secondary circuit boards 104 and 106. As shown in FIG. 1, the flexible insulating materials of the flexible circuit 116 may form a flat, rectangular ribbon capable of folding without damaging the conductors or substantially affecting the current flow.

In some embodiments, the flexible circuit 116 may be attached to a rigid substrate or may form a rigid substrate in order to provide structural support for the flexible circuit along predetermined portions. The rigid substrate may also facilitate holding and moving the contact arrays. For example, the contact arrays 118 may be located along a rigid substrate. The rigid substrate may be a circuit board.

An "interposer," as used herein, includes a planar body having opposing sides with corresponding contact arrays and a plurality of conductive pathways extending therebetween to connect the contact arrays. An interposer may be a printed circuit where mating contacts are etched and formed along two opposing sides of a circuit board. The circuit board may have conductive pathways coupling each mating contact to a corresponding mating contact on the other side. However, in other embodiments, the interposer might not be printed circuit. For example, an interposer may include a carrier having a planar body with a plurality of holes extending therethrough. Stamped and formed mating contacts may be arranged by the carrier such that each mating contact is positioned within a corresponding hole. The mating contacts may interface with one circuit board on one side of the carrier and have ball contacts that are soldered to another circuit board on the other side of the carrier. Furthermore, an interposer may take other forms.

Returning to FIG. 1, the primary and secondary circuit boards 104 and 106 may be in fixed or locked positions and substantially orthogonal to one another before the contact array 118 is moved toward and engages the primary circuit board 104. More specifically, the primary circuit board 104 extends along a lateral plane defined by a longitudinal axis 180 and a horizontal axis 182, and the surface 107 may extend along a vertical plane (i.e., board plane) defined by the longitudinal axis 180 and a vertical axis 184. However, in other embodiments, the primary and secondary circuit boards 104 and 106 may be substantially orthogonal (or perpendicular) to one another (e.g., 90°+/−20°), parallel to one another, or may form some other angle or some other positional relationship with respect to each other. For example, the primary and secondary circuit boards 104 and 106 may be oblique to one another.

As shown in FIG. 1, the electrical connector assembly 110 is affixed to the secondary circuit board 106. However, in alternative embodiments, the electrical connector assembly 110 may be affixed to the primary circuit board 104 and be configured to engage a secondary circuit board when the secondary circuit board is inserted into the electrical system 100. Such embodiments are described in greater detail in U.S. patent application Ser. No. 12/428,806, which is incorporated by reference in the entirety. Furthermore, although not shown in FIG. 1, the card connector assembly 102 may have other structural components, such as sidewalls and a handle, that facilitate shielding the electrical connector assembly 110 and may facilitate inserting/removing the card connector assembly 102.

Figure 2A:
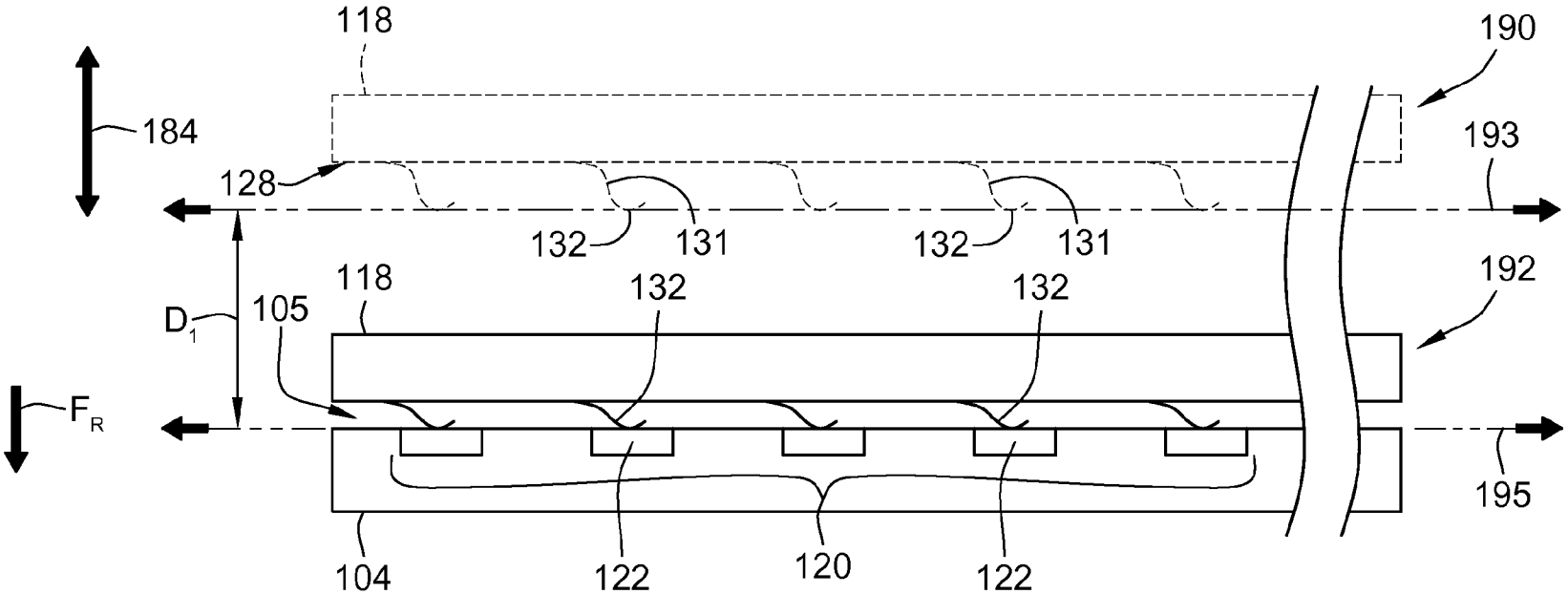
FIG. 2A is a cross-sectional view of a primary circuit board and a moveable contact array that may be used with the electrical system shown in FIG. 1.

FIG. 2A is a cross-sectional view illustrating the contact array 118 in a retracted position 190 (shown in dashed lines) and in an engaged position 192 (solid lines) with respect to the primary circuit board 104. The circuit assembly 114 (FIG. 1) is configured to allow the contact array 118 to be moved bi-directionally along the vertical axis 184 in a linear manner between the retracted position 190 and the engaged position 192. As shown, the contact array 120 of the primary circuit board 104 has mating contacts 122 and the contact array 118 has mating contacts 132. In the retracted position 190, the mating contacts 132 of the contact array 118 are spaced (i.e., a distance $D_1$ away) from corresponding mating contacts 122 of the primary circuit board 104. In the engaged position 192, each mating contact 132 is electrically coupled to or engaged to one of the mating contacts 122.

More specifically, the primary circuit board 104 has the board surface 105 and the contact array 118 has a mating surface 128 that may extend adjacent to and substantially parallel to the board surface 105 (i.e., the mating surface 128 faces the board surface 105). As will be discussed further below, the contact array 118 may be held and moved toward the primary circuit board 104 until the corresponding mating contacts 122 and 132 are engaged. As such, the contact array 118 may be removably coupled to or engaged with the primary circuit board 104.

In the illustrated embodiment, the mating surface 128 and the board surface 105 extend substantially parallel to one other while in the engaged and retracted positions 192 and 190 and in any position therebetween. The contact array 118 may form a contact plane 193 that is substantially parallel to a board plane 195 formed by the board surface 105 and/or the mating contacts 122. As such, each mating contact 132 may be aligned with the corresponding mating contact 122, but spaced apart from the corresponding mating contact 122 by substantially the same distance $D_1$. When the contact array 118 is moved toward the primary circuit board 104 in a linear manner along the vertical axis 184, the distance $D_1$ that separates the corresponding mating contacts 122, and 132 decreases until the mating contacts 132 and mating contacts 122 are engaged.

In alternative embodiments, the contact array 118 may be moved toward and engage the primary circuit board 104 in a non-linear manner. For example, the board surface 105 and the mating surface 128 may be parallel, but the contact array 118 may approach the primary circuit board 104 at an angle such that the mating contacts 122 and mating contacts 132 become aligned when the contact array 118 reaches the engaged position 192. In another alternative embodiment, the board surface 105 and the mating surface 128 may not be parallel when in the retracted position 190, but may become aligned and parallel with each other when the contact array 118 is in the engaged position 192.

In FIG. 2A, the mating contacts 122 of the primary circuit board 104 are pads that are flush with the board surface 105 and the mating contacts 132 of the contact array 118 include resilient beams 131 that project from the mating surface 128. However, the mating contacts 122 and 132 are not intended to be limited to such configurations. For example, in alternative embodiments, the mating contacts 122 may include resilient beams that project from the board surface 105 and the mating contacts 132 may be flush with the mating surface 128 of the contact array 118. Furthermore, the mating contacts 122 and mating contacts 132 may both be pads configured to engage each other.

In the illustrated embodiment, the mating contacts 132 include resilient beams 131 that flex to and from the mating surface 128. The resilient beams 131 resist deflection and exert a resistance force $F_R$ in a direction away from the mating surface 128. As such, the resilient beams 131 may compensate for slight misalignment between the contact array 118 of mating contacts 132 and the contact array 120 of mating contacts 122 when the contact array 118 is moved into the engaged position 192.

In alternative embodiments, the resilient beams 131 of the mating contacts 132 may be bifurcated or the mating contacts 132 may include two separate beams that project toward each other or in opposite directions. The dual-beam mating contacts 132 may be configured to engage one corresponding mating contact 122. As such, the bifurcated beam or the dual-beam mating contacts 132 may have two separate contact points with the corresponding mating contact 122. Also, in other alternative embodiments, the mating contacts 132 may be rounded protrusions or pads that project away from the mating surface 128.

Figure 2B:
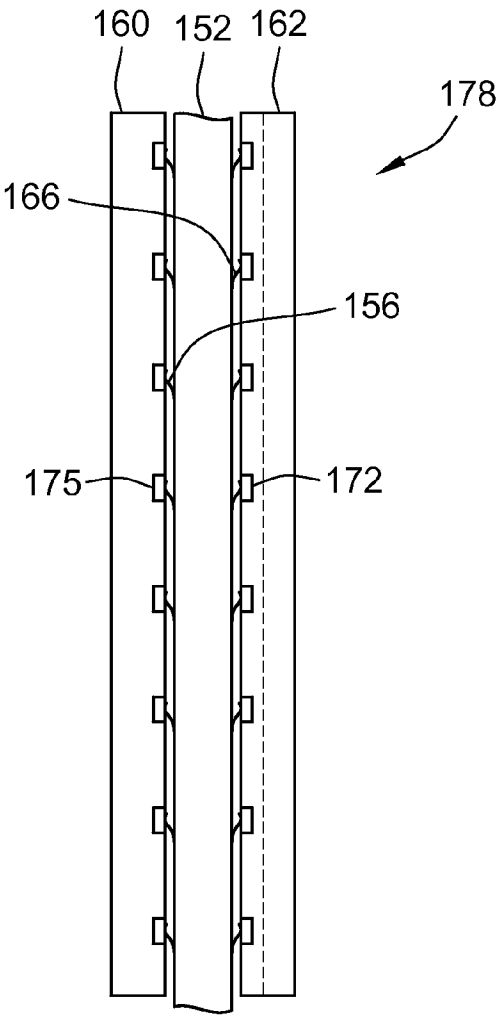
FIG. 2B is a cross-sectional view of a primary circuit board and a moveable contact array that may be used with an electrical system formed in accordance with an alternative embodiment.
Figure 2B:
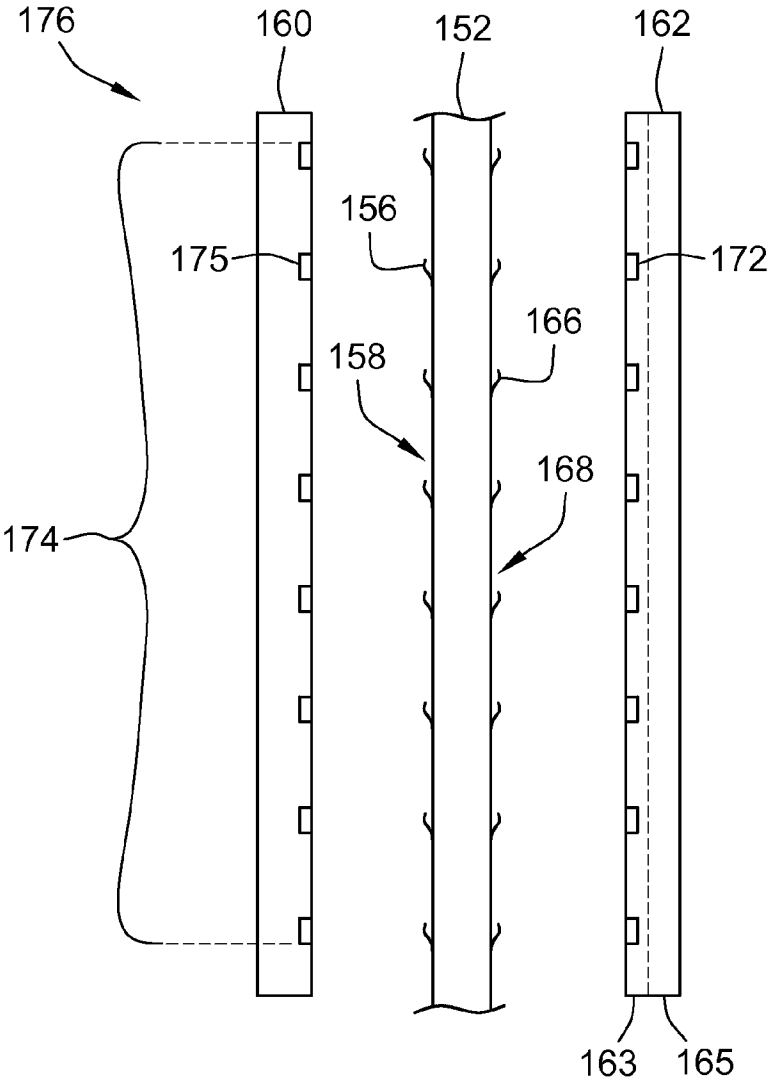

FIG. 2B illustrates a contact array 152 that may be used in an alternative embodiment and shows the contact array 152 in a retracted position 176 and in an engaged position 178 with respect to a secondary circuit board 160 and another contact array 162. As shown, the contact array 152 may be an interposer that includes mating contacts 156 on a mating surface 158 that faces the secondary circuit board 160. The contact array 152 may also have mating contacts 166 on a mating surface 168 that faces the contact array 162.

The contact array 162 may include, for example, a flex circuit 163 that is coupled to a substrate or stiffener 165. The contact array 162 has an array 170 of mating contacts 172 that are configured to engage the mating contacts 166 on the mating surface 168. The secondary circuit board 160 may have a contact array 174 of mating contacts 175 configured to engage the mating contacts 156 on the mating surface 158. As shown, when the contact arrays 152 and 162 and the secondary circuit board 160 are moved to the engaged position 178, the mating contacts 156 engage the mating contacts 175 and the mating contacts 166 engage the mating contacts 172. As such, the contact array 152 may be an intervening electrical component that is sandwiched between the secondary circuit board 160 and the contact array 162 to establish an electrical connection therebetween.

Figure 3:
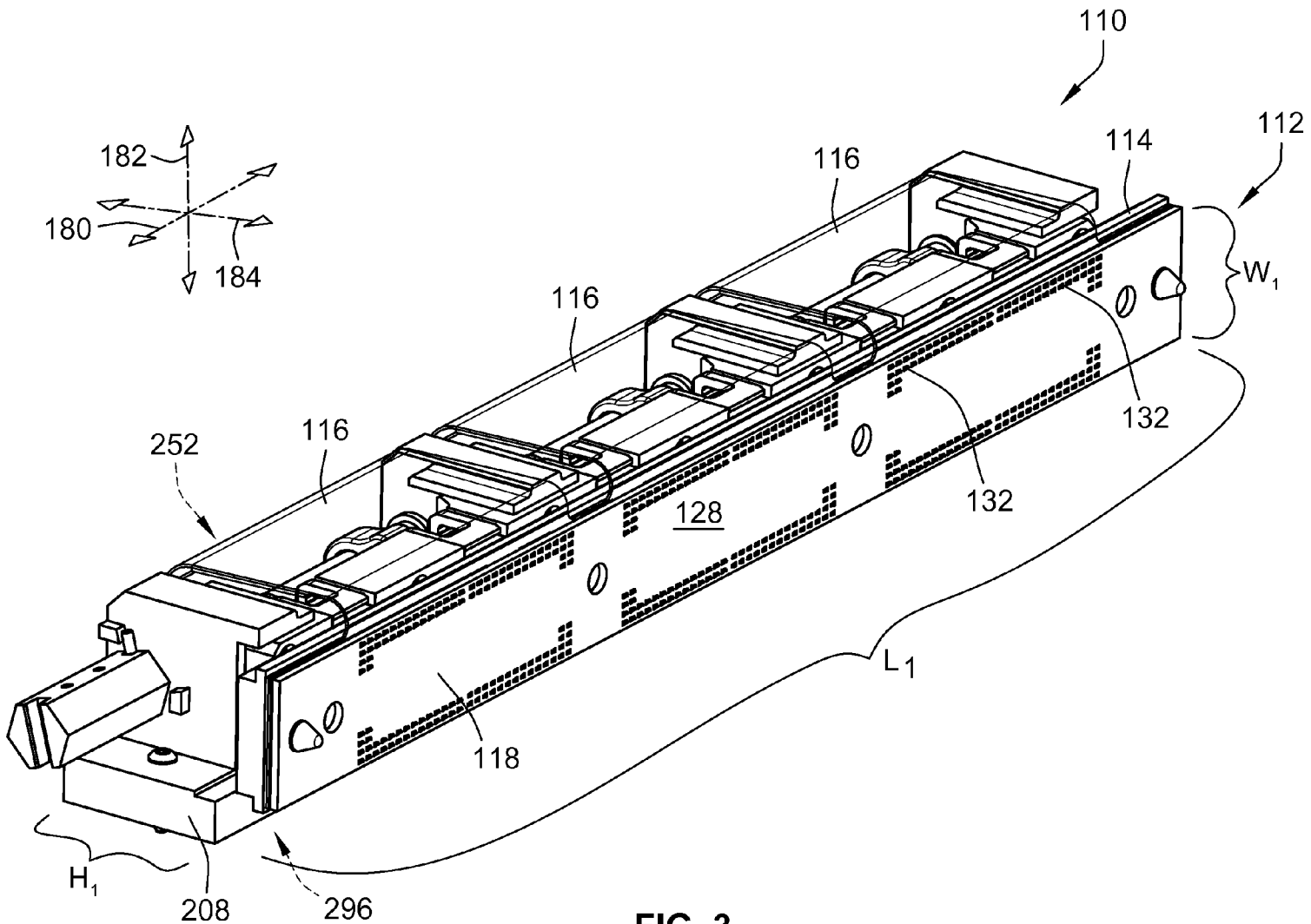
FIG. 3 is a perspective view of a mating side of an electrical connector assembly that may be used with the card connector assembly shown in FIG. 1.
Figure 4:
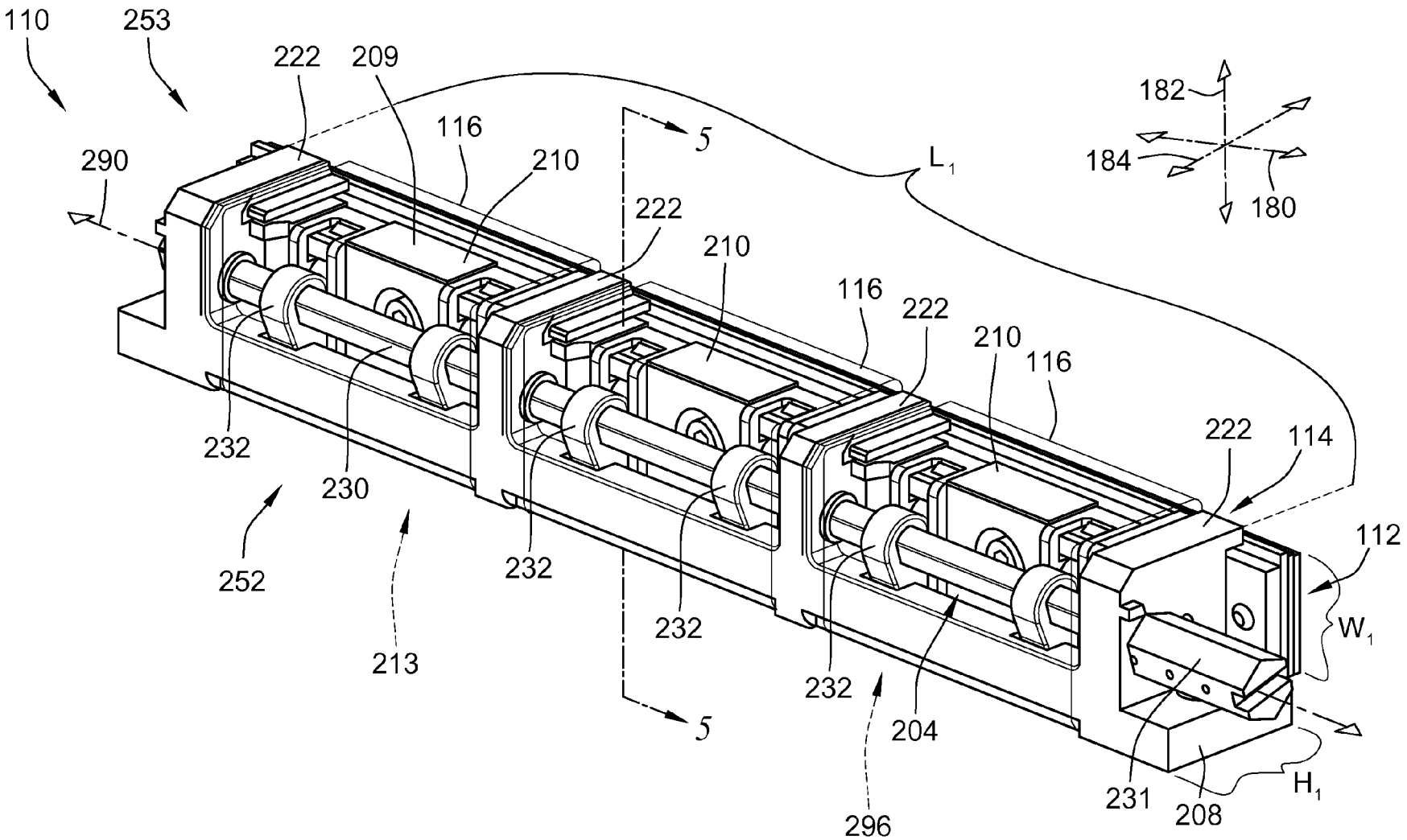
FIG. 4 is a perspective view of a non-mating side of the electrical connector assembly shown in FIG. 3.

FIGS. 3 and 4 are isolated perspective views of the mating side 112 and a non-mating side 252, respectively, of the electrical connector assembly 110. As shown, the electrical connector assembly 110 is oriented with respect to the axes 180, 182, and 184. The electrical connector assembly 110 has a substantially rectangular shape that includes a width $W_1$ that extends along the axis 182, a length $L_1$ that extends along the axis 180, and a height $H_1$ that extends along the axis 184. The electrical connector assembly 110 may include a base frame 208 and a coupling mechanism 204 (FIG. 4) that is supported by the base frame 208. The base frame 208 may be coupled (e.g., fastened) to the secondary circuit board 106 (FIG. 1) so that the base frame 208 has a fixed relationship with respect to the secondary circuit board 106. For example, the base frame 208 may be located proximate to and extend lengthwise along the side edge 126 (FIG. 1) of the secondary circuit board 106.

Also, the electrical connector assembly 110 includes the circuit assembly 114 that includes the flexible circuits 116 (indicated by phantom lines in FIG. 4) coupled to the mating side 112. The circuit assembly 114 also includes the contact array 118 and another contact array 213 (FIG. 4). The flexible circuits 116 (also called flex circuit sections) are coupled to the contact array 213 at a board side 296 of the electrical connector assembly 110 and extend around the electrical connector assembly 110 to the mating side 112. As shown in FIG. 3, the mating side 112 includes the contact array 118 having the mating surface 128 and the mating contacts 132. The contact, plane 193 (FIG. 2A) of the contact array 118 extends along a plane parallel to the axes 180 and 182. As shown in FIG. 3, a longer dimension (e.g. a length) of the contact plane 193 extends parallel to the longitudinal axis 180.

However, in alternative embodiments, a shorter dimension (e.g., a width) of the contact plane 193 may extend parallel to the longitudinal axis 180. For instance, the length $L_1$ of the electrical connector assembly 110 may be positioned proximate to and oriented to extend along the side edge 125 (shown in FIG. 1). Also, in alternative embodiments, the mating side 112 may include a plurality of separate contact arrays. Each separate contact array may extend along a different plane or a common plane.

With reference to FIG. 4, the coupling mechanism 204 is configured to move the mating side 112 between the retracted and engaged positions 190 and 192 (FIG. 2A). The coupling mechanism 204 includes an axle 230 that extends along a central axis 290, a plurality of cam fingers 232 coupled to the axle 230, and a header 209 having multiple header sections 210 that are coupled to the mating side 112. The axle 230 has an end 231 that is configured to be engaged by an operator for rotating the axle 230 about the axis 290. Furthermore, the base frame 208 includes a plurality of axle supports 222 that support the axle 230.

Figure 5:
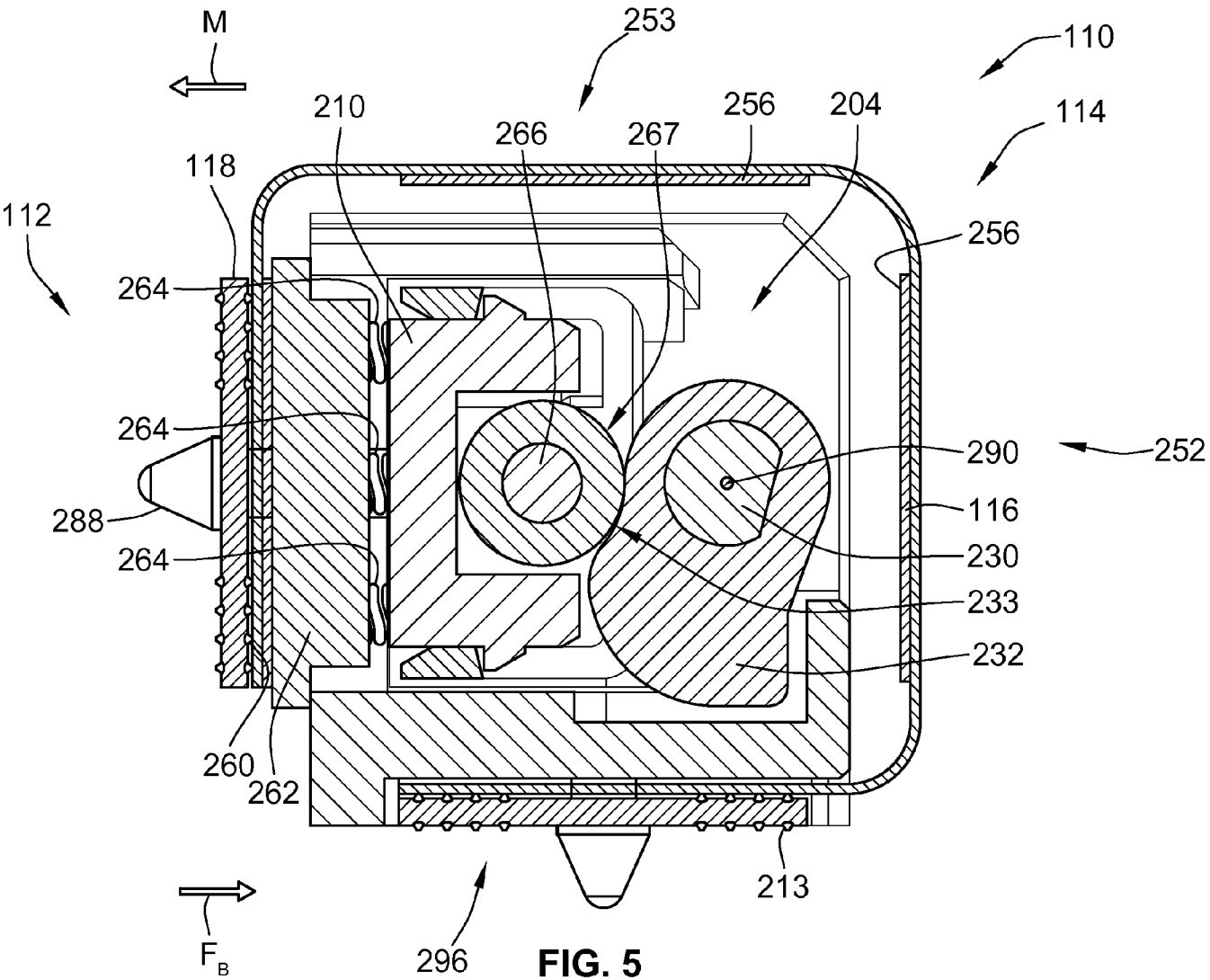
FIG. 5 is a cross-sectional view of the electrical connector assembly taken along the line 5-5 shown in FIG. 4.

FIG. 5 is cross-sectional view of the electrical connector assembly 110 taken along the line 5-5 shown in FIG. 4. As shown, the flexible circuit 116 extends around the coupling mechanism 204 to communicatively couple the contact array 213 on the board side 296 to the contact array 118 of the mating side 112. More specifically, the flexible circuit 116 extends around a perimeter of the cross-section of the electrical connector assembly 110 from the contact array 213 along the non-mating sides 252 and 253. Alternatively, the flexible circuit 116 may extend in an opposite direction as shown in FIG. 5 (i.e., the flexible circuit 116 can extend clockwise around the electrical connector assembly 110 in alternative embodiments). The flexible circuit 116 or the circuit assembly 114 may also include rigid substrates or board stiffeners 256 for supporting and providing a shape to the flexible circuit 116. More specifically, each of the board stiffeners 256 may extend along a portion of the flexible circuit 116 that extends along a non-mating side. Furthermore, the flexible circuit 116 may have a longer length than the perimeter of the non-mating sides 252 and 253 to allow the mating side 112 to be moved between the retracted and engaged positions 190 and 192 (FIG. 2A).

The contact arrays 118 and 213 and the flexible circuit 116 of the circuit assembly 114 may be molded together into one unit. The contact array 213 may be an interposer that engages the flexible circuit 116 on one side of the interposer and engages the secondary circuit board 106 (FIG. 1) on the other side of the interposer. The mating contacts of the contact array 213 may include press-fit contacts or solder-ball contacts that are affixed to the secondary circuit board 106 to facilitate holding the electrical connector assembly 110 thereto. Alternatively, other mating contacts may be used.

The mating side 112 includes the contact array 118, a substrate 260, and a panel 262 that are all fastened together (e.g., with screws or adhesives) and extend substantially parallel to the axis 290 of the axle 230. The contact array 118 in FIG. 5 is an interposer, but the contact array 118 may take other forms in alternative embodiments. As shown, the substrate 260 is coupled to the flexible circuit 116 and is sandwiched between the contact array 118 and the panel 262. The substrate 260 may include contacts and conductors (not shown) that communicatively couple the contact array 118 to the flexible circuit 116. The panel 262 supports the substrate 260 and the contact array 118 and is floatably attached to the headers 210 (only one header 210 is shown in FIG. 5) via a plurality of springs 264. The mating side 112 also includes an alignment projection 288 that projects away from the contact array 118.

Also shown in FIG. 5, the coupling mechanism 204 includes a roll bar 266 that is coupled to and extends through the headers 210 parallel to the axis 290. The roll bar 266 has a roll surface 267 that contacts a finger surface 233 of the cam finger 232. In FIG. 5, the coupling mechanism 204 and the mating side 112 are in the retracted position 190. In the retracted position 190, the cam finger 232 extends longitudinally toward the board side 296 and the finger surface 233 is shaped to at least partially conform to the shape of the roll surface 267 so that the axle 230 does not inadvertently rotate.

Figure 6:
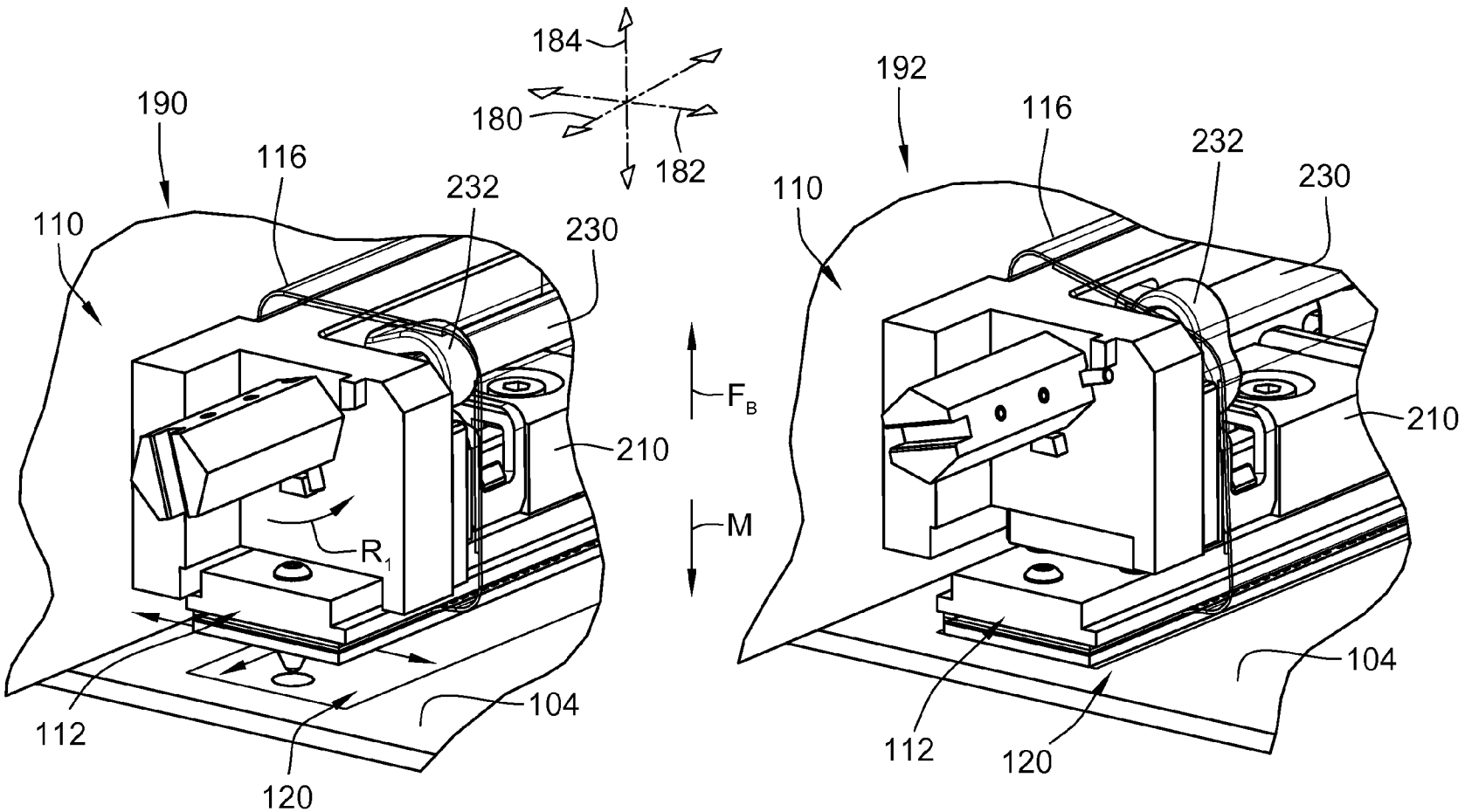
FIG. 6 is a perspective view of an end of the electrical connector assembly shown in FIG. 3 while in retracted and engaged positions.

FIG. 6 illustrates a portion of the electrical connector assembly 110 in the retracted position 190 and in the engaged position 192. When the axle 230 is rotated in a direction as indicated by the arrow $R_1$, the cam fingers 232 push the roll bar 266 (FIG. 5) away from the axle 230 in a mating direction M. The header 210, likewise, moves in the mating direction M thereby moving the mating side 112 away from the axle 230 and toward the contact array 120 of the primary circuit board 104. Although not shown, the coupling mechanism 204 may be biased (e.g., by a spring force) such that a force $F_B$ biases the header 210 and the roll bar 266 in a direction toward the axle 230. (The mating direction M and the biasing force $F_B$ are also shown in FIG. 5.) When the axle 230 is rotated in a direction opposite $R_1$, the biasing force $F_B$ moves the header 210 and the roll bar 266 toward the axle 230 and away from the primary circuit board 104. Accordingly, the mating side 112 may be moved between the retracted and engaged positions 190 and 192.

Also shown in FIG. 6, when the mating side 112 (shown in FIG. 6) moves from the retracted position 190 to the engaged position 192, the mating side 112 pulls the flexible circuit 116 therealong. Due to the board stiffeners 256 (FIG. 5) that extend along the non-mating sides 252 and 253 (FIG. 5) the shape of the flexible circuit 116 changes in a predetermined manner.

Figure 7:
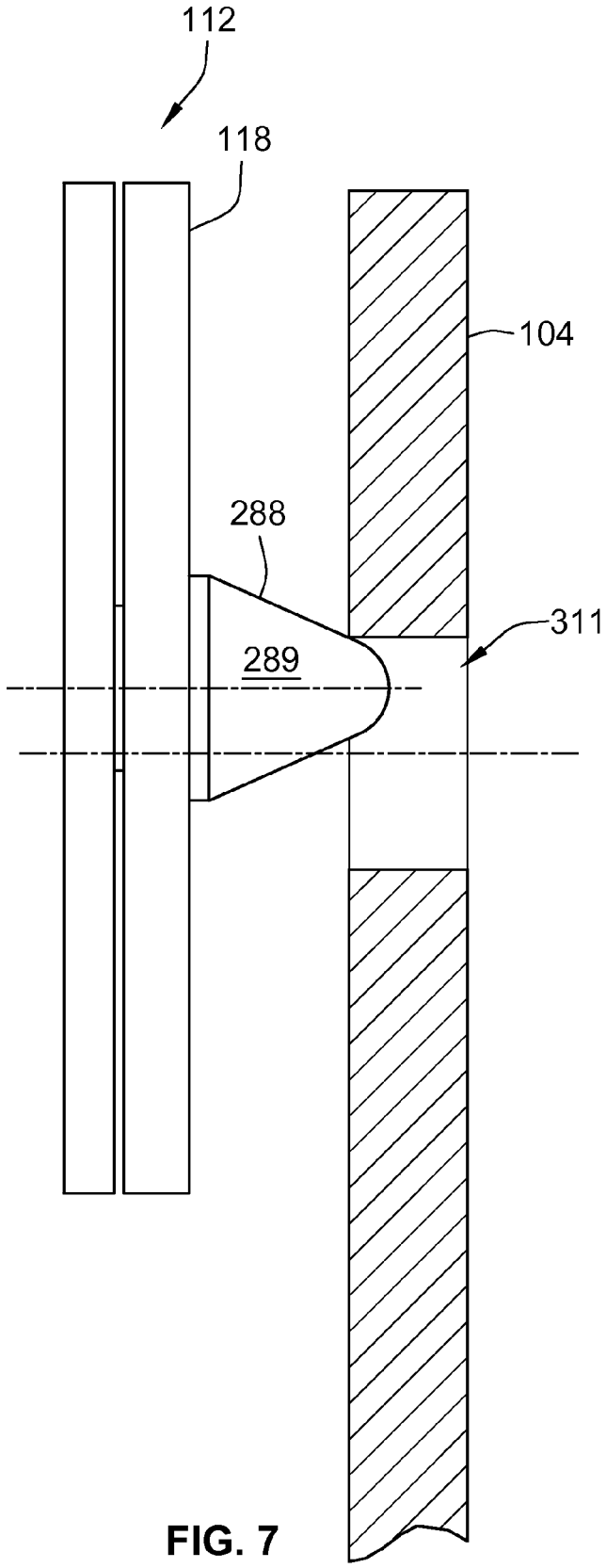
FIG. 7 is a cross-sectional view of a portion of the electrical connector assembly shown in FIG. 6 as the electrical connector assembly is moved between the retracted and engaged positions.

FIG. 7 illustrates an interaction between the alignment projection 288 of the mating side 112 and an aperture 311 of the primary circuit board 104. Embodiments described herein may utilize one or more alignment mechanisms to facilitate aligning the mating contacts 132 of the contact array 118 (FIG. 2A) and the mating contacts 122 of the contact array 120 (FIG. 2A). As used herein, an "alignment feature" includes alignment projections, apertures, and edges or frames that may cooperate with each other in aligning the contacts. As shown in FIG. 7, the alignment projection 288 may be a conical projection coupled to and extending from the contact array 118. The aperture 311 may be a cavity or passage that is sized and shaped to receive the alignment projection 288 when the contact array 118 is moved from the retracted position 190 to the engaged position 192 (FIG. 2A).

In some embodiments, the alignment feature(s) have a fixed position with respect to an array of mating contacts on a corresponding electrical component (e.g., the contact array 118 or the primary circuit board 104). Although FIG. 7 illustrates the mating side 112 having the alignment projection 288 and the primary circuit board 104 having the aperture 311, in alternative embodiments, the mating side 112 may have the aperture 311 and the primary circuit board 104 may have the alignment projection 288.

In some embodiments, the mating side 112 may float with respect to the header 210 (FIG. 3). For example, the springs 264 (FIG. 5) may allow movement in various directions when a force redirects the contact array 118. More specifically, when the contact array 118 is moved toward the primary circuit board 104, a surface 289 of the alignment projection 288 may engage the corresponding aperture 311. Due to the shape of the surface 289, the alignment projection 288 and corresponding aperture 311 cooperate with each other to align and electrically couple the mating contacts 122 and 132. Because the primary circuit board 104 is stationary and the contact array 118 is floatable, the contact array 118 may be moved in any of the directions shown by arrows in FIG. 6. For example, the contact array 118 may shift side-to-side or up-down (i.e., along the lateral plane formed by the axes 180 and 182 (FIG. 6)) in order to align the arrays of mating contacts 122 and 132. Furthermore, the springs 264 may also allow slight rotation of the contact array 118 about the axes 180, 182, and 184 (FIG. 6) if the contact array 118 and the primary circuit board 104 are not oriented properly.

Furthermore, in embodiments where the mating contacts 132 include resilient beams 131 (FIG. 2A), the springs 264 may work in conjunction with the resilient beams 131 to electrically engage the contact array 118 to the primary circuit board 104. The combined resilient forces of the mating contacts 132 and the floatable capability of the mating side 112 may cooperate together in properly aligning the contact array 118 with the contact array 120.

Alternative alignment mechanisms may be used. For example, the alignment projection 288 may be a cylindrical pin that projects from the mating side 112. The primary circuit board 104 may have a conical or funnel-like aperture with a hole at the bottom configured to receive the pin. When the contact array 118 is moved toward the primary circuit board 104, the pin may engage the surface of the conical aperture and be directed toward the hole where the pin is eventually received. As such, this alternative alignment mechanism may operate similarly to the illustrated mechanism described above. In addition, the alignment projection 288 may have other shapes (e.g., pyramid, semi-spherical).

In other alternative embodiments, the primary circuit board 104 may have the alignment projection 288 and the mating side 112 may have the corresponding aperture 311. Furthermore, alternative embodiments may use multiple alignment features on each end or both ends of the primary circuit board 104 and the mating side 112. For example, the mating side 112 may have one alignment projection 288 configured to engage an aperture 311 in the primary circuit board 104 and also one aperture 311 configured to receive an alignment projection 288 from the primary circuit board 104.

Also, although not shown, the alignment features may also be a frame or other guiding structure that engages an edge or projection when the contact array 118 approaches the primary circuit board 104. The frame and the edge (or projection) have fixed positions with respect to their corresponding contacts. More specifically, a frame may surround the contact array 120 and project from the primary circuit board 104. When the contact array 118 approaches the primary circuit board 104, an edge (or projection) of the contact array 118 may engage the frame. The frame may be shaped to redirect the contact array 118 if the contact array 118 approaches the primary circuit board 104 along a misaligned path so that the corresponding contacts engage. Alternatively, the contact array 118 or the connector assembly 110 may have a frame or other guiding structure and the primary circuit board 104 may have an edge or projection. Similar to above, when the contact array 118 approaches the primary circuit board 104, the frame may engage the edge and redirect the contact array 118 so that the corresponding contacts engage.

Accordingly, if the mating contacts are misaligned as the contact array 118 approaches the primary circuit board 104, the mating side 112 may float with respect to the primary circuit board 104 in order to align and engage the mating contacts. The springs 264 allow the mating side 112 to move in various directions. Moreover, the springs 264 may be configured to provide an outward mating force in the mating direction M to maintain the electrical connection between the mating contacts 132 of the contact array 118 and the mating contacts 122 of the primary circuit board 104.

Figure 8:
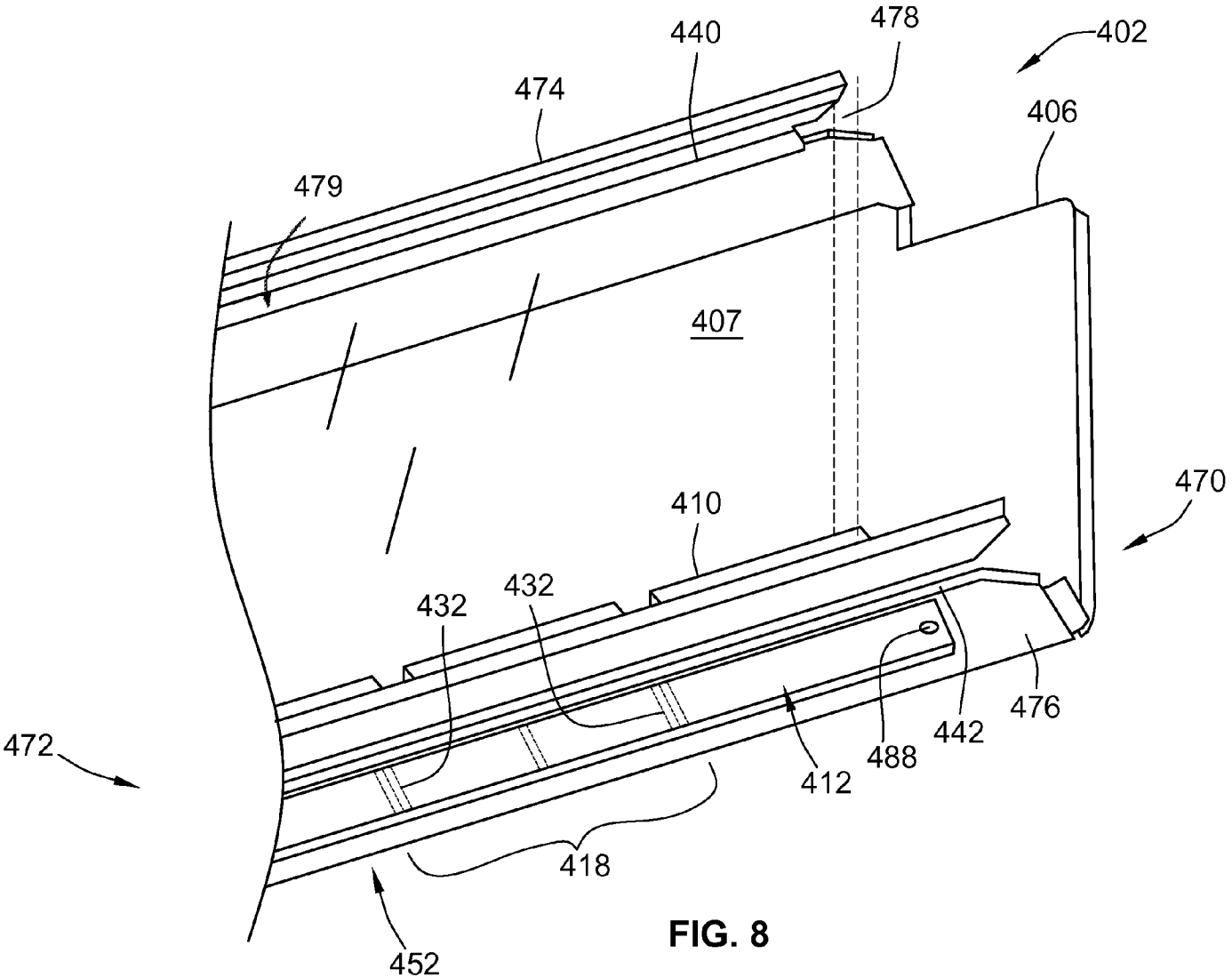
FIG. 8 is a perspective view of a mating side of a removable card connector assembly formed in accordance with another embodiment.

FIG. 8 is a bottom perspective view of a removable card connector assembly 402 formed in accordance with another embodiment. As shown, the card connector assembly 402 has a leading end 470 and a trailing end 472. The card connector assembly 402 may include a pair of opposing sidewalls 474 and 476 that extend from the leading end 470 to the trailing end 472. The card connector assembly 402 may be similarly constructed to the card connector assembly 102 of FIG. 1 and include a secondary circuit board 406 having a surface 407 and an electrical connector assembly 410 that is coupled to the surface 407. The sidewalls 474 and 476 may project away from the surface 407 in a perpendicular manner. The card connector assembly 402 may also have an additional sidewall 478 (indicated by phantom lines) that extends parallel to the secondary circuit board 406 so that the electrical connector assembly 410 is held therebetween. Accordingly, the sidewalls 474, 476, and 478 and the secondary circuit board 406 form a connector frame or structure 479 that may shield the electrical connector assembly 410 therein. In some embodiments, the sidewall 478 may be another circuit board that may have another electrical connector assembly coupled thereto.

In the illustrated embodiment, the card connector assembly 402 is a server blade that is configured to be slidably engaged or coupled to a mother board of a server system (not shown). For example, the card connector assembly 402 may have guiding features 440 and 442 for slidably coupling to corresponding features or elements within the server system. In FIG. 8, the guiding features 440 and 442 are shown as guide channels that are sized and shaped to receive, e.g., cam pins or rails within the server system. Alternatively, the guiding features 440 and 442 may be cam pins or rails that engage guide channels within the server system. When the card connector assembly 402 is inserted into the server system, the card connector assembly 402 and, more specifically, the electrical connector assembly 410 has a fixed orientation with respect to a contact array 420 (shown in FIG. 9) within the server system.

Figure 9:
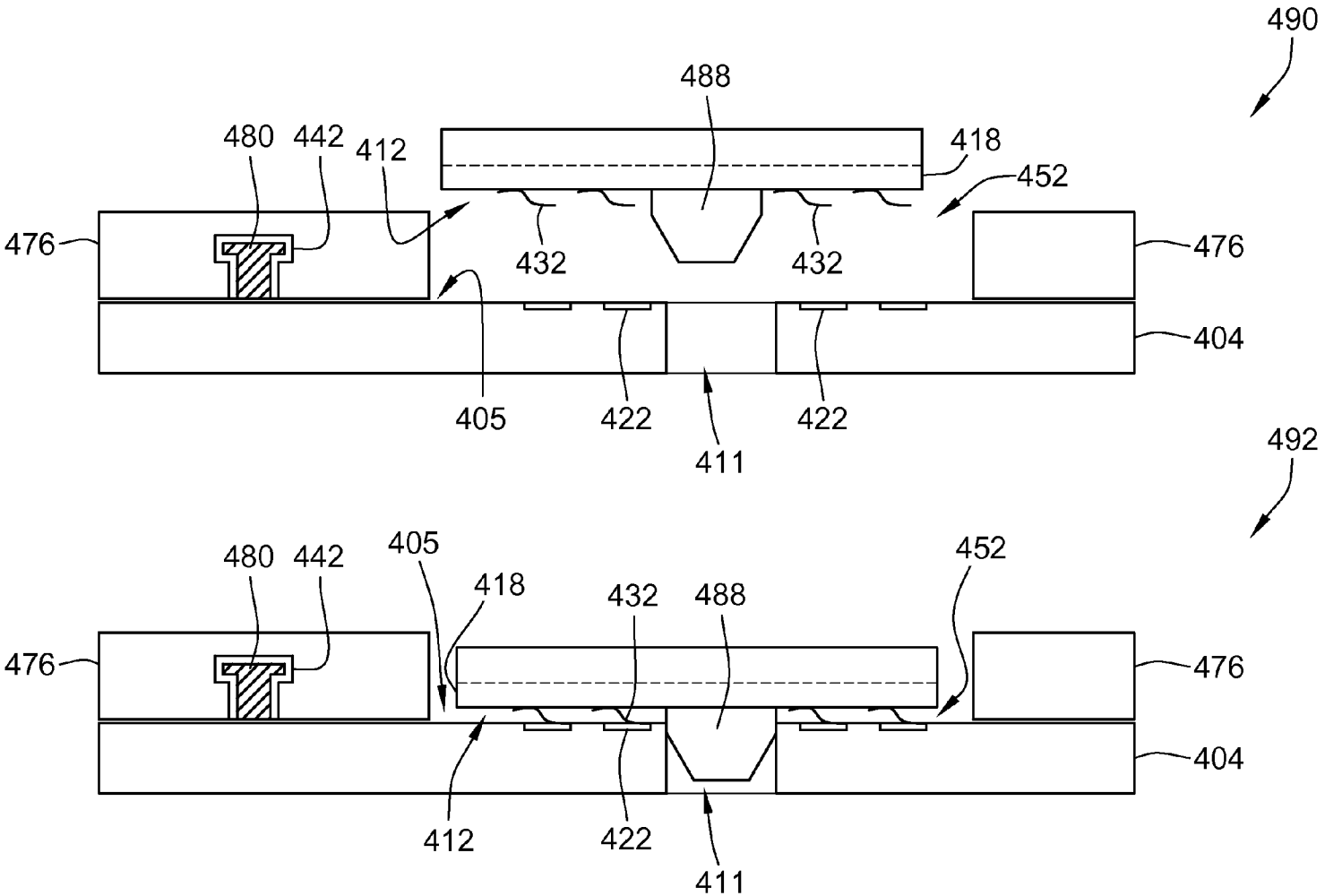
FIG. 9 is a cross-sectional view of a portion of the card connector assembly shown in FIG. 8 as an electrical connector assembly is moved between retracted and engaged positions.

The electrical connector assembly 410 includes a mating side 412 that is configured to be removably coupled to a surface 405 (shown in FIG. 9) of a primary circuit board 404 (FIG. 9). Also shown, the sidewall 476 may have an opening 452 that is sized and shaped to allow the mating side 412 to move therethrough to engage the primary circuit board 404. In alternative embodiments, the sidewall 476 may be integrally formed with, e.g., a base frame of the electrical connector assembly 410. In such embodiments, the electrical connector assembly 410 forms and includes the guiding feature 442 and the opening 452. Also shown in FIG. 8, the mating side 412 may include one or more contact arrays 418 of mating contacts 432 and one or more alignment projections 488 that projects therefrom.

FIG. 9 is a cross-sectional view of the sidewall 476 as the mating side 412 is moved from a retracted position 490 to an engaged position 492. In the retracted position 490, a contact array 418 of the mating side 412 is spaced from the board surface 405 of the primary circuit board 404. The contact array 418 includes the mating contacts 432, and the board surface 405 includes a contact array of mating contacts 422. As shown, the mating contacts 422 are pads and the mating contacts 432 are beams. However, the mating contacts 422 and 432 may take other forms in alternative embodiments.

Prior to inserting the card connector assembly 402 (FIG. 8) into the server system and alongside the primary circuit board 404, the mating side 412 may be in the retracted position 490. To insert the card connector assembly 402, the guiding feature 442 proximate to the leading end 470 (FIG. 8) may engage a complementary guiding feature 480 along the board surface 405 of the primary circuit board 404. When the card connector assembly 402 is fully inserted and is located in the desired position and orientation with respect to the mating contacts 422, the mating side 412 may be moved from the retracted position 490 to the engaged position 492. As the mating side 412 moves toward the board surface 405, any misalignment is corrected by engagement of the alignment projection 488 within an aperture 411 of the primary circuit board 404. As described above with respect to FIG. 5, the alignment projection 488 may cooperate with the aperture 411 to facilitate electrically engaging the mating contacts 432 and 422. As shown in FIG. 9, the opening 452 may be sized and shaped to provide extra space for the mating side 412 to maneuver within in order to allow the mating side 412 to be redirected.

Figure 10:
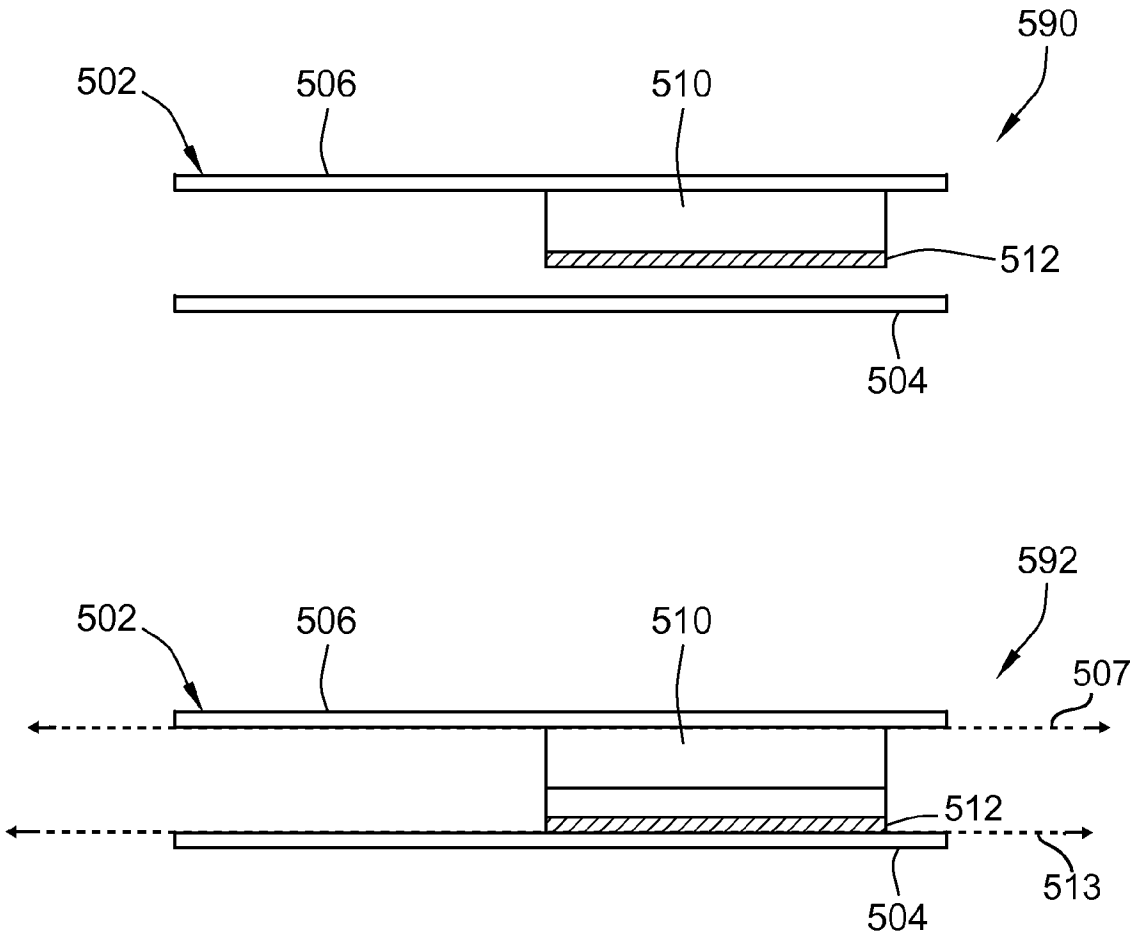
FIG. 10 is a top-down view of a removable card connector assembly formed in accordance with an alternative embodiment.

FIG. 10 is a top view of a removable card connector assembly 502 formed in accordance with an alternative embodiment while in a retracted position 590 and an engaged position 592 with respect to a primary circuit board 504. The card connector assembly 502 and the primary circuit board 504 may be components in an electrical system (not shown). In contrast to previously described embodiments wherein the card connector assemblies 102 and 402 are shown as electrically interconnecting circuit boards that are oriented perpendicular with respect to each other, alternative embodiments may be used to interconnect circuit boards that are oriented parallel to one another. As shown in FIG. 10, an electrical connector assembly 510 is attached to a secondary circuit board 506 of the card connector assembly 502 and located proximate to the primary circuit board 504. As shown, the electrical connector assembly 510 includes a mating side 512 that may be moved between a retracted position 590, where the mating side 512 is spaced from and not electrically coupled to the primary circuit board 504, and an engaged position 592, where the mating side 512 is located alongside the primary circuit board 504 and electrically coupled thereto. As shown in FIG. 10, a contact plane 513 of the mating side 512 extends parallel to a board plane 507 of the secondary circuit board 506 when in the engaged position 592.

The electrical connector assembly 510 may be similarly constructed as the electrical connector assemblies 110 and 410. However, the electrical connector assembly 510 is configured to move the mating side 512 in a linear manner away from the secondary circuit board 506. In such configurations, for example, the mating side 512 may be positioned where the non-mating side 253 (FIG. 5) is located.

Accordingly, embodiments described herein may be used to interconnect primary and secondary circuit boards that extend along respective planes that are perpendicular to one another or parallel to one another. Furthermore, in alternative embodiments, the primary and secondary circuit boards may be oriented in other positional relationships.

Thus, it is to be understood that the above description is intended to be illustrative, and not restrictive. As such, many other electrical connector assemblies and coupling mechanisms may be used that electrically couple an array of mating contacts to another array of mating contacts other than the electrical connector assemblies and the coupling mechanism described above. For example, the electrical connector assembly and coupling mechanisms may be like the electrical connector assemblies and coupling mechanisms described in U.S. patent application Ser. No. 12/428,806, which is incorporated by reference in the entirety.

In addition, the above-described embodiments (and/or aspects thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third." etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A removable card connector assembly configured to be inserted into and engage an electrical system, the card connector assembly comprising:

a circuit board having a surface that extends along a board plane in a longitudinal direction;

an electrical connector assembly coupled to the circuit board, the electrical connector assembly including a flexible circuit and a moveable contact array of mating contacts coupled to the flexible circuit, the moveable contact array being configured to engage a system contact array of mating contacts in the electrical system; and a coupling mechanism configured to selectively move the moveable contact array between a retracted position, at which the moveable contact array is spaced apart from the system contact array, and an engaged position, at which the moveable and system contact arrays are engaged with one another, the coupling mechanism holding the moveable contact array in the retracted position when inserted into the electrical system, the moveable contact array being arranged along a contact plane that extends in the longitudinal direction when in the engaged position.

2. The card connector assembly in accordance with claim 1 further comprising an alignment feature that has a fixed position relative to the moveable contact array, said alignment feature cooperating with another alignment feature of the electrical system to align the moveable and system contact arrays when the moveable contact array is selectively moved into the engaged position.

3. The card connector assembly in accordance with claim 1 wherein the contact plane is oriented perpendicular to the board plane when in the engaged position.

4. The card connector assembly in accordance with claim 1 wherein the contact plane extends parallel to the board plane when in the engaged position.

5. The card connector assembly in accordance with claim 1 wherein the mating contacts of the moveable contact array include resilient beams configured to engage the mating contacts of the system contact array.

6. The card connector assembly in accordance with claim 1 further comprising a sidewall that extends along the circuit board in the longitudinal direction, the sidewall including a guiding feature that is configured to slidably engage with the electrical system.

7. The card connector assembly in accordance with claim 1 wherein the moveable contact array advances in a linear direction when moved between the retracted and engaged positions.

8. The card connector assembly in accordance with claim 1 wherein the moveable contact array is moved in a mating direction between the retracted and engaged positions, the mating direction being substantially perpendicular to the contact plane.

9. The card connector assembly in accordance with claim 1 wherein the moveable contact array is moved in a mating direction between the retracted and engaged positions, the moveable contact array being floatable in at least one direction that is substantially perpendicular to the mating direction.

10. The card connector assembly in accordance with claim 1 further comprising a connector frame that houses the electrical connector assembly, the connector frame being sized and shaped to be inserted into and removed from the electrical system and configured to be removably coupled to the electrical system such that the connector frame is readily separated from the electrical system.

11. The card connector assembly in accordance with claim 1 wherein the coupling mechanism includes an axle and a header that supports the moveable contact array, the axle and the header being operatively coupled such that the header drives the moveable contact array between the engaged and retracted positions when the axle is rotated about a central axis.

12. The card connector assembly in accordance with claim 1 wherein the coupling mechanism includes an operator-controlled element that is configured to be engaged by an operator to selectively move the moveable contact array.

13. A removable card connector assembly configured to be inserted into and engage an electrical system, the card connector assembly comprising:

a circuit board having a surface that extends along a board plane in a longitudinal direction;

an electrical connector assembly coupled to the circuit board, the electrical connector assembly including a flexible circuit and a moveable contact array of mating contacts coupled to the flexible circuit, the moveable contact array being configured to engage a system contact array of mating contacts in the electrical system;

a coupling mechanism configured to move the moveable contact array between a retracted position, at which the moveable contact array is spaced apart from the system contact array, and an engaged position, at which the moveable and system contact arrays are engaged with one another, the moveable contact array being arranged along a contact plane that extends in the longitudinal direction when in the engaged position; and a sidewall that extends along the circuit board in the longitudinal direction, wherein the sidewall includes an opening that extends along the longitudinal direction and is sized and shaped to allow the moveable contact array of mating contacts to move therethrough.

14. A removable card connector assembly comprising:

a connector frame having leading and trailing ends and a longitudinal axis extending therebetween;

an electrical connector assembly supported by the connector frame and comprising a flexible circuit and a moveable contact array of mating contacts coupled to the flexible circuit, the moveable contact array being configured to engage a system contact array of mating contacts in an electrical system, the moveable contact array being arranged along a contact plane that extends along the longitudinal axis, the contact plane facing a mating direction that is substantially perpendicular to the longitudinal axis; and a coupling mechanism configured to selectively move the moveable contact array substantially in the mating direction, the coupling mechanism selectively moving the moveable contact array between a retracted position, at which the moveable contact array is spaced apart from the system contact array, and an engaged position, at which the moveable and system contact arrays are engaged with one another, the coupling mechanism holding the moveable contact array in the retracted position when inserted into the electrical system.

15. The card connector assembly in accordance with claim 14 further comprising an alignment feature that has a fixed position relative to the moveable contact array, said alignment feature cooperating with another alignment feature of the electrical system to align the moveable and system contact arrays when the moveable contact array is moved into the engaged position.

16. The card connector assembly in accordance with claim 14 wherein the mating contacts of the moveable contact array include resilient beams configured to engage the mating contacts of the system contact array.

17. The card connector assembly in accordance with claim 14 wherein the connector frame includes a sidewall that extends along the longitudinal axis, the sidewall having an opening that is sized and shaped to allow the moveable contact array of mating contacts to move therethrough.

18. The card connector assembly in accordance with claim 14 wherein the moveable contact array is floatably coupled to the coupling mechanism, the moveable contact array being floatable in at least one direction that is substantially perpendicular to the mating direction.

19. The card connector assembly in accordance with claim 14 wherein the connector frame comprises a circuit board, the moveable contact array being electrically coupled to the circuit board.

20. The card connector assembly in accordance with claim 14 wherein the connector frame is sized and shaped to be inserted into and removed from the electrical system, the connector frame configured to be removably coupled to the electrical system such that the connector frame is readily separated from the electrical system.

* * * * *